US007651229B1

(12) United States Patent
Rimback et al.

(10) Patent No.: US 7,651,229 B1
(45) Date of Patent: Jan. 26, 2010

(54) MIRROR ASSEMBLY WITH FLEXIBLE NECK

(75) Inventors: Peter D. Rimback, South Euclid, OH (US); James F. Vidmar, Willoughby, OH (US); Chi Wai Patrick Poon, Kwun Tong (HK)

(73) Assignee: HSN Improvements LLC, St. Petersburg, FL (US)

( * ) Notice: Subject to any disclaimer, the term of this patent is extended or adjusted under 35 U.S.C. 154(b) by 0 days.

(21) Appl. No.: 11/429,227

(22) Filed: May 8, 2006

(51) Int. Cl.
*G02B 5/08* (2006.01)
*G02B 7/182* (2006.01)

(52) U.S. Cl. ..... 359/840; 359/850; 359/871; 359/872

(58) Field of Classification Search ..... 359/872
See application file for complete search history.

(56) References Cited

U.S. PATENT DOCUMENTS 6,099,133 A * 8/2000 Wright ..... 359/880
6,220,717 B1 * 4/2001 Pastore ..... 359/871
6,682,198 B2 * 1/2004 Mangano ..... 359/840
2005/0068646 A1 * 3/2005 Lev et al. ..... 359/871
2005/0231835 A1 * 10/2005 Tokushita et al. ..... 359/871

OTHER PUBLICATIONS

"Radial." Merriam-Webster Online Dictionary. 2009. Merriam-Webster Online. Jan. 8, 2009 <http://www.merriam-webster.com/dictionary/radial>.*

* cited by examiner

*Primary Examiner*—Stephone B Allen
*Assistant Examiner*—Jade R Callaway
(74) *Attorney, Agent, or Firm*—Kenyon & Kenyon LLP

(57) ABSTRACT

A mirror assembly including a mirror, a base and a flexible neck connecting the mirror and the base such that the neck can be manually manipulated to adjust the position of the base and the mirror relative to each other. The mirror assembly further includes a light source located on or adjacent to the mirror, and a power-source receiving receptacle located in the base, wherein the power-source receptacle cavity is electrically coupled to the light source.

21 Claims, 10 Drawing Sheets

MIRROR ASSEMBLY WITH FLEXIBLE NECK

The present invention is directed to a mirror assembly, and more particularly, to a mirror assembly having a flexible neck such that the mirror assembly can be moved into various configurations.

BACKGROUND

Vanity mirrors, cosmetic mirrors and the like are widely used when applying makeup, grooming hair, and for other personal uses and the like. Many existing mirror assemblies are set in a single fixed configuration, or movable into limited configurations, which restricts the utility of such mirrors. In addition, many existing mirror assemblies do not include an integral light, which further limits the utility of the mirrors.

In addition, many existing mirror assemblies are unable to be folded to a compact configuration for storage, for example for use in suitcases, purses and the like. Further, many existing systems for assembling a mirror require that at least some portion of the mirror surface be used as a clamping surface, thereby reducing the effective viewing area of the mirror.

Accordingly, there is a need for a mirror assembly which can be formed into various configurations, which has an integral light, which can be moved into a compact arrangement, and which has an improved arrangement for assembling the mirror.

SUMMARY

In one embodiment, the present invention is a mirror or mirror assembly which can be formed into a variety of configurations, which includes a light, and which can be moved into a compact position, and which has an improved arrangement for assembling the mirror. In particular, in one embodiment the invention is a mirror assembly including a mirror, a base and a flexible neck connecting the mirror and the base such that the neck can be manually manipulated to adjust the position of the base and the mirror relative to each other. The mirror assembly further includes a light source located on or adjacent to the mirror, and a power-source receiving receptacle located in the base, wherein the power-source receptacle cavity is electrically coupled to the light source.

DETAILED DESCRIPTION

Figure 1:
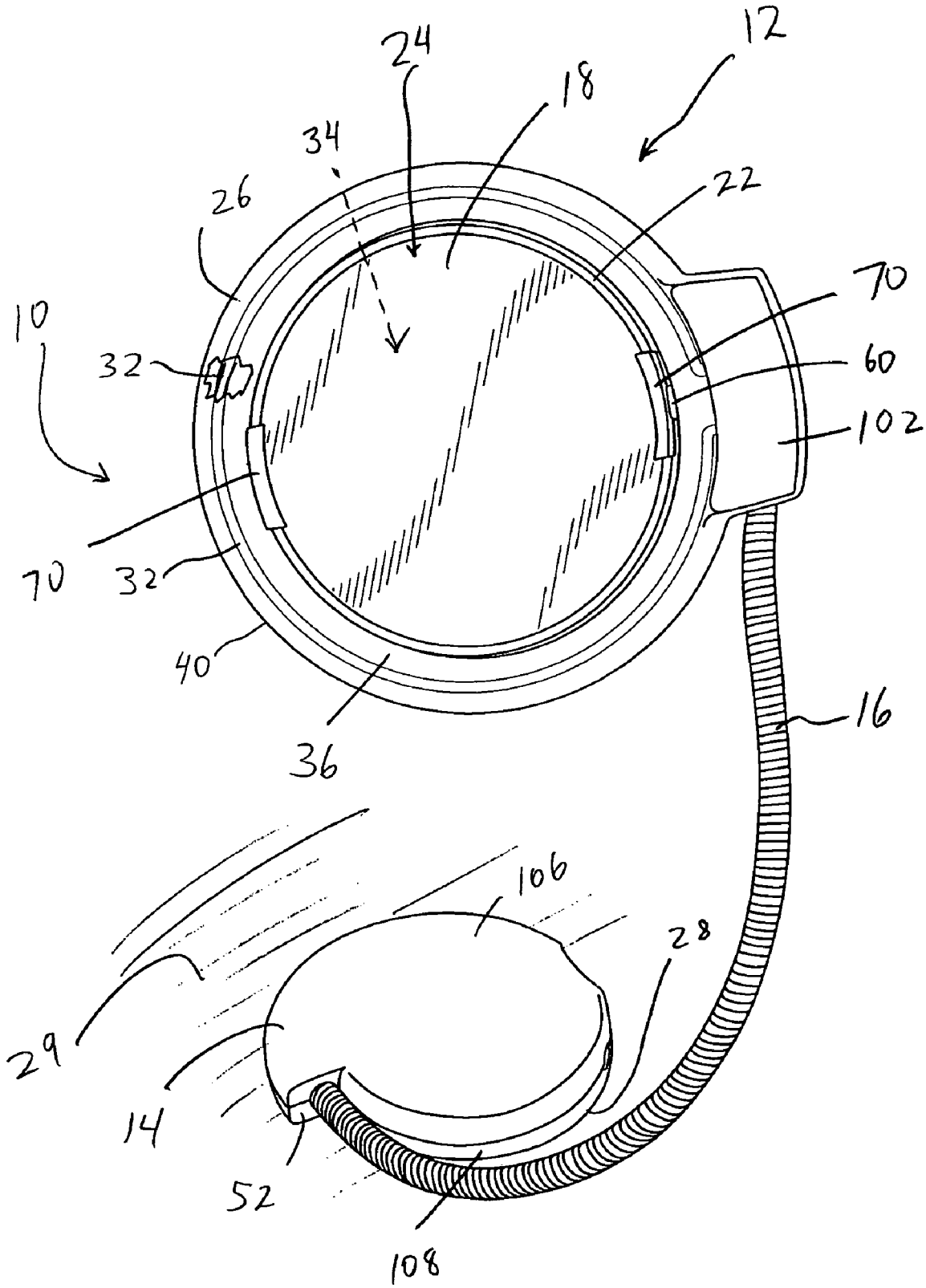
FIG. 1 is a front perspective view of one embodiment of the mirror assembly of the present invention.

As shown in FIG. 1, in one embodiment the mirror assembly of the present invention, generally designated 10, includes a generally disc-shaped mirror 12, a generally disc-shaped base 14 and a flexible neck 16 connecting the mirror 12 and the base 14. The flexible neck 16 may be a "gooseneck" member, such as a self-supporting generally cylindrical grooved metal coil. The neck 16 may be a generally tubular hollow flexible steel coil that is chrome plated and has an outer diameter of about 10 mm. The neck 16 may have sufficient stiffness that the neck 16 can be manually bent and manipulated into various shapes or configurations, yet generally retains such shapes or configurations when released. The mirror 12 and base 14 may be generally rigid (i.e., not flexible or able to be manipulated in the same manner as the neck 16).

The mirror 12 of the mirror assembly 10 can, in one embodiment be generally considered to constitute the components at the upper end of the mirror assembly 10. More particularly, the mirror 12 may include a pair of reflective plates or mirror surfaces 18, 20 (one of which is shown in FIG. 1) mounted on or in a mirror frame or base plate 22 to thereby form a reflective plate assembly 24. The reflective plate assembly 24 is in turn mounted in a mirror housing 26.

Figure 2:
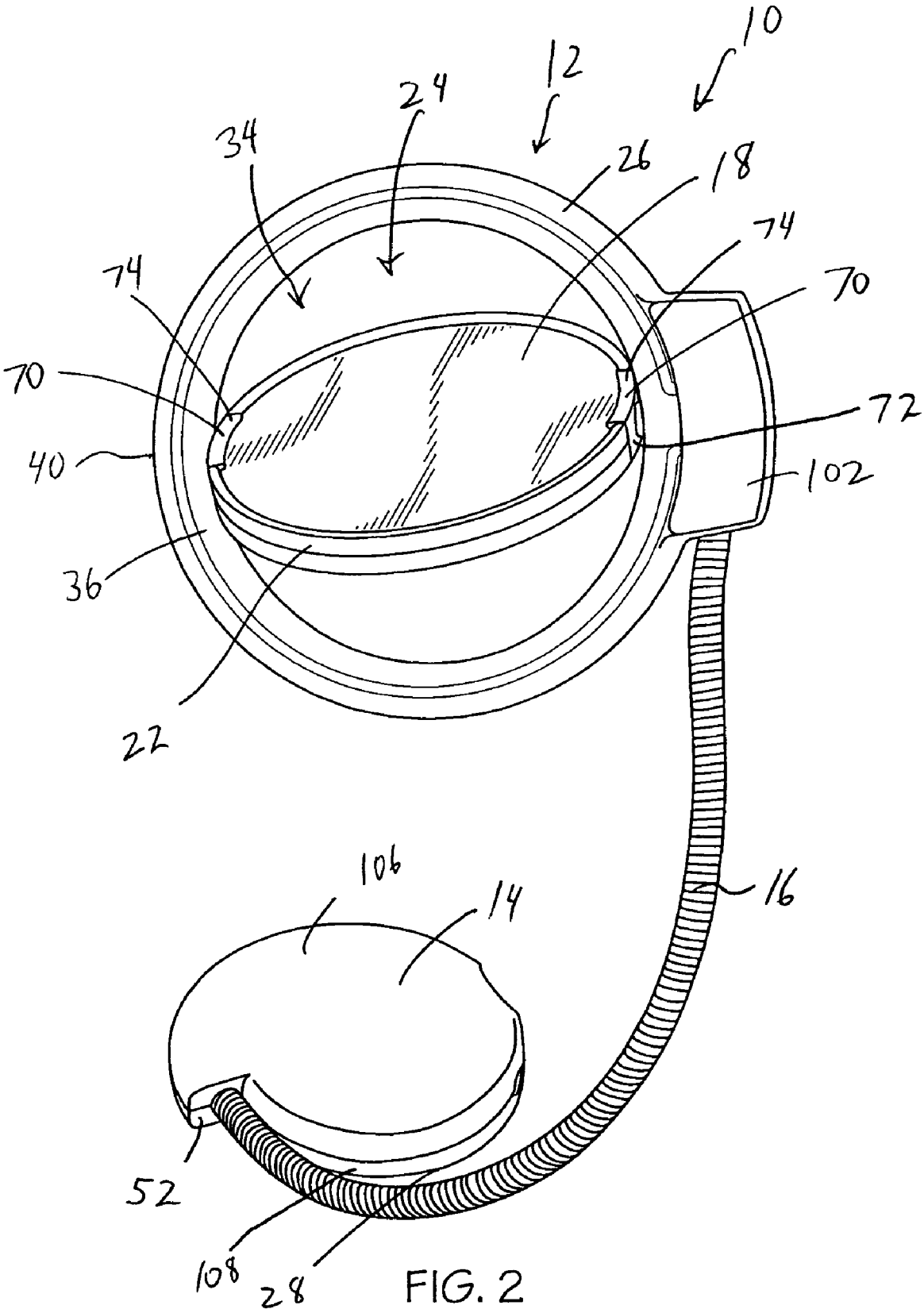
FIG. 2 is a front perspective view of the mirror assembly of FIG. 1, with the mirror pivoted from its position shown in FIG. 1.

As can be seen in FIG. 2, the reflective plate assembly 24 is rotatably mounted in the mirror housing 26. In this manner, when the reflective plate assembly 24 is double-sided (i.e., includes a reflective plate 18, 20 on opposite sides thereof), the reflective plate assembly 24 can be pivoted from a first position wherein one of the reflective plates 18, 20 faces a first direction (i.e., forwardly), and a second position wherein the other reflective plate 18, 20 faces the first direction (i.e., forwardly). If desired, the reflective plates 18, 20 may have different magnifications. The second reflective plate 20 may, for example, be generally flat and not include any magnification (i.e., a magnification factor of one), and the first reflective plate 18 may have a generally concave shape to provide a higher magnification (i.e., a magnification factor of five, eight, ten or the like).

In the illustrated embodiment, the reflective plate assembly 24 is generally circular. Thus, in this case the reflective plates 18, 20, mirror frame 22, and mirror housing 26 are all circular to allow the reflective plate assembly 24 to pivot within the mirror housing 26. However, the reflective plate assembly 24 and mirror housing 26 can have a variety of other shapes, including but not limited to, oval, square, rectangular, and the like.

The flexible neck 16 allows the mirror assembly 10 to be arranged in various positions and configurations. For example, besides the configurations shown in FIGS. 1 and 2, the neck 16 can be stretched to a nearly vertical position to provide a mirror assembly 10 having maximum height (i.e., when the mirror assembly 10 is resting on a vanity table and the user is standing). In addition, the neck 16 can be oriented generally horizontally in a serpentine manner to provide a mirror assembly 10 having minimal height (i.e., when the mirror assembly 10 is resting on a vanity table and the user is sitting). The flexible neck 16 also allows the mirror 12 to be tilted to various angles and moved forward/backward and left/right as desired by the user.

The base 14 may have a generally flat support surface 28 on or forming its bottom surface thereof to provide stable support to the mirror assembly. In the illustrated embodiment, the support surface 28 has small pads or feet 30 (FIGS. 3 and 4) located thereon. However, the feet 30 need not be included, or, alternately, the bottom surface of the feet 30 can be considered to constitute the support surface 28. In this manner, the mirror assembly 10 and the base 14 can be located on a generally flat face 29 (i.e., the top surface of a vanity table, desk, dresser, countertop or the like) such that the support surface 28 rests on the flat face 29 and the weight of the mirror 12 and neck 16 are entirely supported by the base 14, as shown in FIGS. 1 and 2. In this configuration, the mirror 12 and neck 16 do not contact the flat face 29 and the mirror 12 and neck 16 are entirely supported by the base 14.

The mirror 12 or mirror housing 26 may have an integral light source 32. In particular, in the illustrated embodiment, the mirror housing 26 is generally annular or formed as a generally flat disk having a central opening 34 (FIG. 2) formed therein. As shown in FIG. 1, the front flat face 36 of the mirror housing 26 may be made of a generally transparent or generally translucent material. The mirror housing 26 may include the light source 32 therein and in the illustrated embodiment the light source 32 is a generally circular light bulb that is visible through the front face 36 (see also partial cut-away section of FIG. 1). The light source 32 may extend around generally the entire perimeter of the mirror housing 26, or of the reflective plates 18, 20, to provide increased light on the reflective plates 18, 20 and on the user's face or other item to be viewed in the mirror 12.

The light source 32 may take the form of a cold cathode fluorescent lamp ("CCFL"). In the illustrated embodiment, only the front face 36 of the mirror housing 26 is generally transparent or translucent. However, if desired, the back flat surface 38, or even the curved end surface 40, of the mirror housing 26 may be generally transparent or translucent. The transparent or translucent surfaces of the mirror housing 26 may be partially or generally transparent or translucent to provide a softening or diffusing effect to the light provided by the light source 32.

The base 14 of the mirror assembly 10 may include a power source or a power-source receiving receptacle operatively coupled to the light source. For example, in the embodiment shown in FIG. 10, the power-source receiving receptacle may take the form of a receptacle 42 for receiving batteries 44 therein. The power-source receiving receptacle 42 may also include or take the form of an input port or receptacle 46 which is configured to receive the plug of an AC or DC adapter cord such that the light source 32 may be powered by an external electrical power source, such as a household electrical outlet. The power-source receiving receptacles 42, 46 are electrically coupled to a circuit board 48. The power-source receiving receptacles 42, 46 are electrically coupled to the light source 32 by a wire or wires 50 which extend from the circuit board 48 to the light source 32 via the central cavity of the flexible hollow neck 16.

For example, the light source 32 may be able to operate from four AA 1.5 volt batteries 44 or from a six volt AC/DC adapter. The base 14 may also include a high frequency inverter power supply (not shown) for the light source 32. The mirror assembly 10 may also include an on/off switch 52 located in the base 14 to control the flow of current/power to the light source 32.

Figure 3:
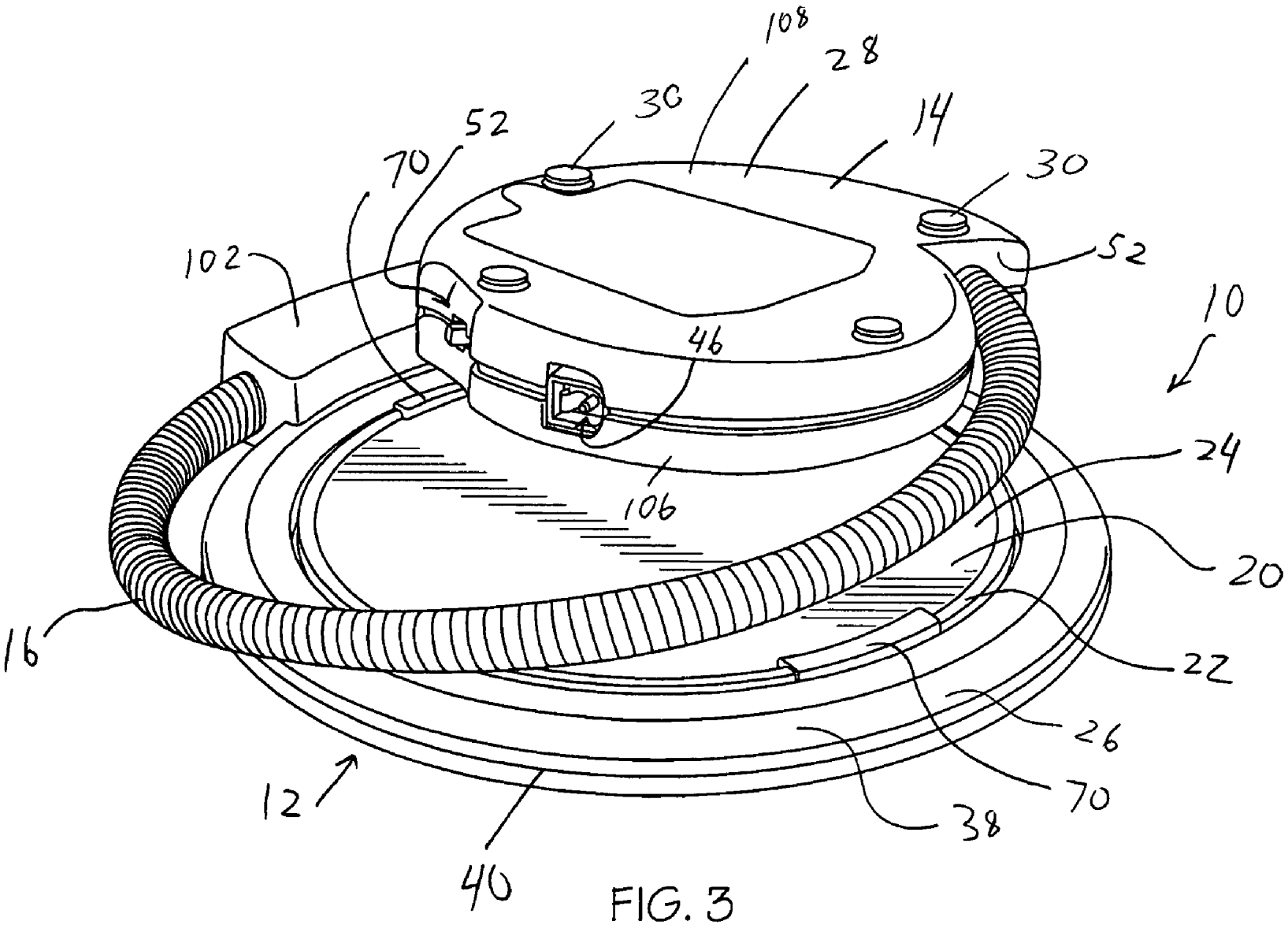
FIG. 3 is a front perspective view of the mirror assembly of FIG. 1, partially folded into its compact position.
Figure 4:
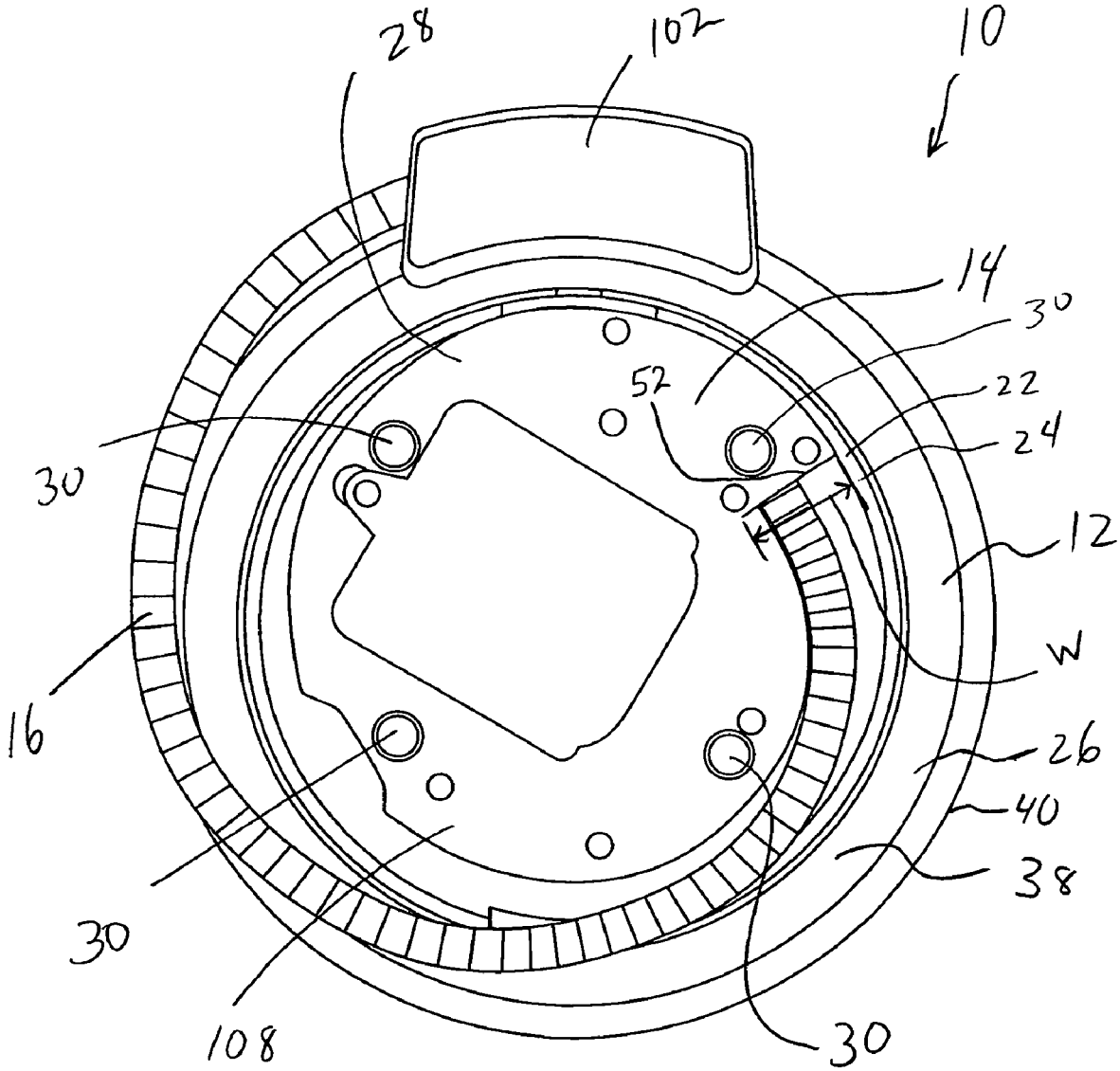
FIG. 4 is a bottom view of the mirror assembly of FIG. 1, folded into its compact position.

As shown in FIGS. 3 and 4, the mirror assembly 10 can be moved to a compact position. In particular, with reference to FIG. 3, in order to move the mirror assembly 10 to its compact position, the mirror 12 and base 14 are moved toward each other while the neck 16 is generally coiled around the base 14. As shown in FIG. 4, when the mirror assembly 10 is moved to its fully compact position, the base 14 is moved immediately adjacent to, flat against, and generally co-planar with the mirror 12.

Figure 5:
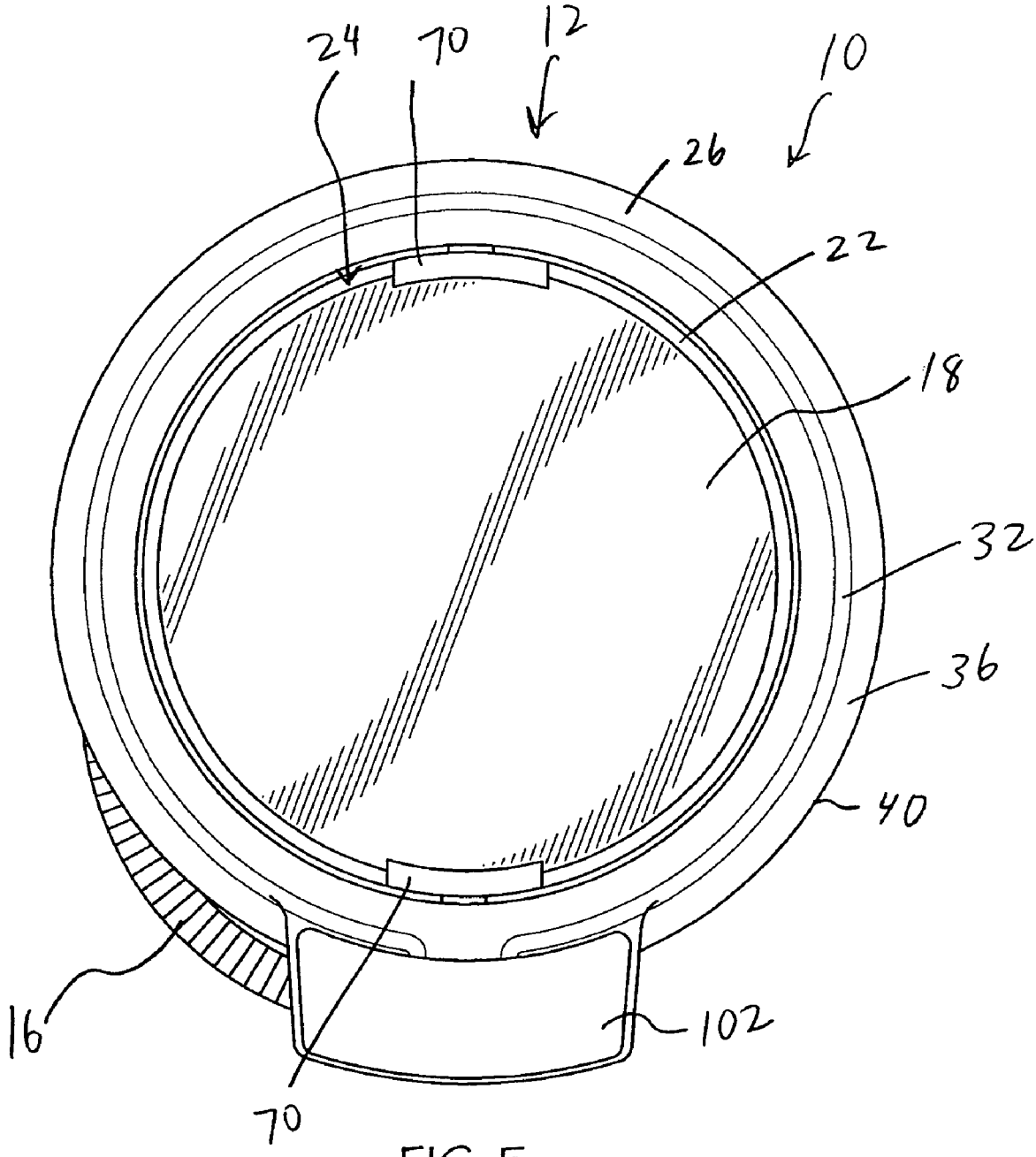
FIG. 5 is a top view of the mirror assembly of FIG. 4.

The base 14, mirror 12 and neck 16 may each define an outline or footprint in top view. As shown in FIGS. 4 and 5, when the mirror assembly 10 is moved to its compact position, the footprint of the base 14 may be entirely contained within the footprint of the mirror 12. In addition, the footprint of the neck 16 may be almost entirely contained within the footprint of the mirror 12. The only part of the neck 16 which is not contained within the footprint of the mirror 12 is the portion of the neck 16 adjacent to where the neck 16 attaches to the mirror 12 (see FIG. 5). If desired, the mirror 12 may have a smaller footprint than the base 14 (rather than the other way around) to allow the mirror assembly 10 to be formed into its compact configuration.

When the mirror assembly 10 is in its compact position, the neck 16 generally wraps around the base 14. In addition, the base 14 and neck 16 may have about the same thickness (i.e., the dimension perpendicular to the page of FIG. 4) such that when the mirror assembly 10 is in its compact position, the neck 16 does not protrude above the base 14. In other words, the neck 14 may occupy the same elevation as the base 16.

The outer perimeter of the base 14 may be formed in somewhat of a "spiral" shape such that the base 14 has a generally radially-extending connecting area 52 (see FIG. 1) to which the neck 16 connected or passes through. The connecting area 52 has a width w (see FIG. 4) that is roughly equal to the diameter of the neck 16 (or less than about double the diameter of the neck 16) to allow the neck 16 to be closely conformed around the base 14. In addition, this configuration of the base 14 allows the neck 16 to be attached to the base 14 such that the central axis of the neck 16 is generally parallel and coplanar with the base 16 at the connection area 52. This allows the neck 16 to be wrapped around the base 14 in a co-planar manner.

Figure 8:
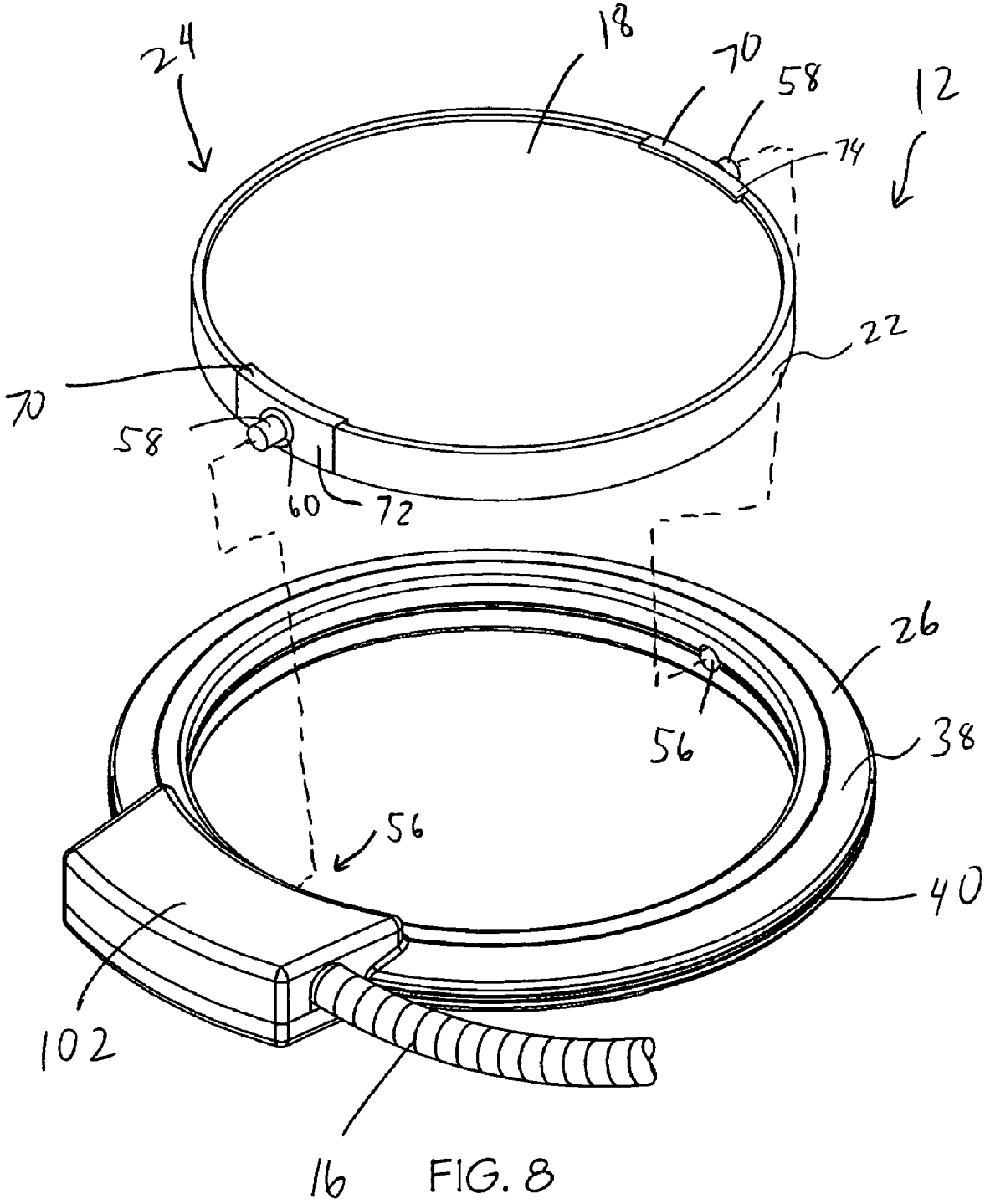
FIG. 8 is an upper perspective view of the upper portion of the mirror assembly of FIG. 1, with the reflective plate assembly exploded away from the mirror housing.

As shown in FIG. 8, the reflective plate assembly 24 is pivotally coupled to the mirror housing 26. The mirror housing 26 includes a pair of opposed openings 56 which receive corresponding protrusions 58 of the reflective plate assembly 24 therein to form the rotational coupling. Each protrusion 58 may have an o-ring 60 fitted thereon to provide interference/friction gripping when the o-rings 60 are compressed between the reflective plate assembly 24 and the mirror housing 26. In this manner, the reflective plate assembly 24 can be retained at any rotational position within the mirror housing 26.

Figure 6A:
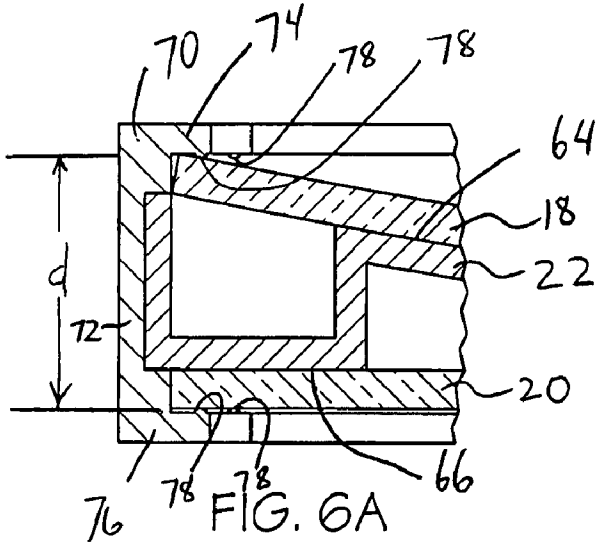
FIG. 6A is a detailed view of the indicated area of FIG. 6.
Figure 6:
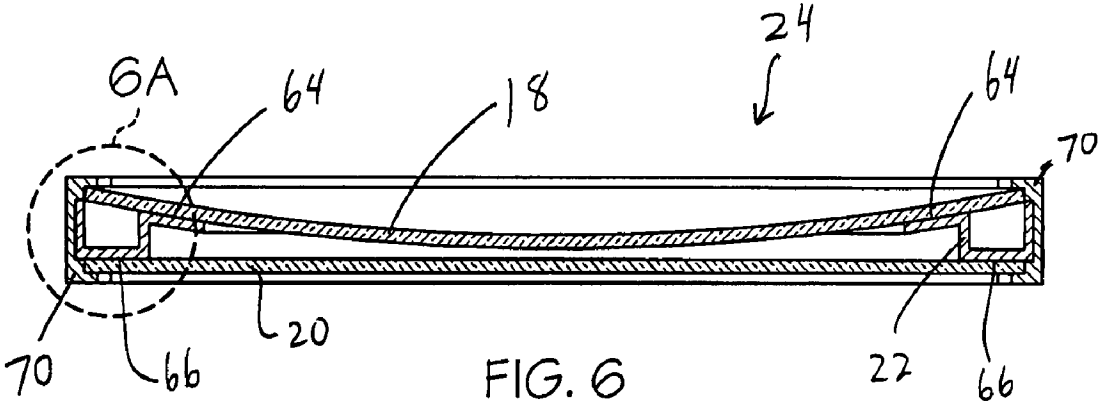
FIG. 6 is a side cross section of the reflective plate assembly of the mirror assembly of FIG. 1.
Figure 7:
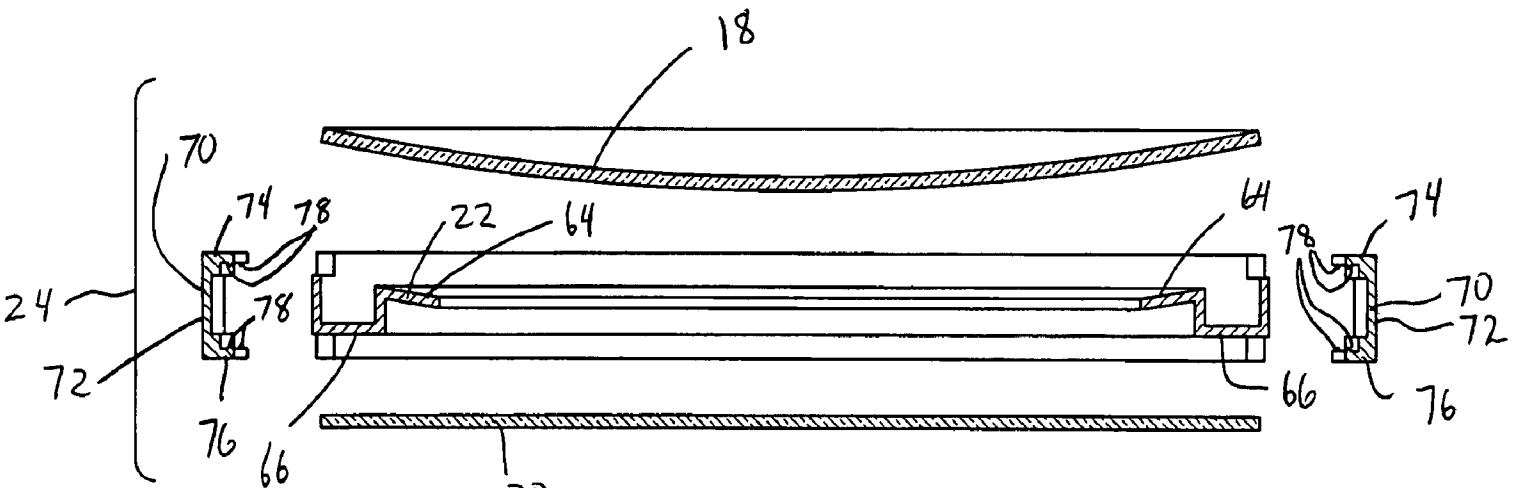
FIG. 7 is an exploded view of the reflective plate assembly of FIG. 6.

The reflective plate assembly 24 is shown in cross section in FIGS. 6 and 7. As can be seen, the reflective plate assembly 24 may include a base plate/mirror frame 22 which receives the reflective plates 18, 20 on opposite sides thereof. The base plate 22 may include a curved support surface 64 which matches the curvature of the concave reflective plate 18 to provide support to the concave reflective plate 18. The base plate 22 also includes a flat support surface 66 around its perimeter to provide support to the flat reflective plate 20.

It may be desired that the curved support surface 64 and flat support surface 66 not extend entirely across the width (i.e., the left-to-right dimension of FIGS. 6 and 7) of the base plate 22 to aid in molding of the base plate 22. Otherwise it could be difficult to allow separation of the two mold halves during the molding process.

The reflective plate assembly 24 may also include a pair of coupling clips 70 to couple the reflective plates 18, 20 to the base plate 22. Each coupling clip 70 may be generally "C"- shaped in side view, including a base portion 72 and a pair of legs 74, 76 extending away from the base. Each leg 74, 76 may include a relatively small nub or protrusion 78 extending inwardly from the associated leg 74, 76.

In order to form the reflective plate assembly 24, the reflective plates 18, 20 are located on the associated support surface 64, 66 of the base plate 22. If desired, a small amount of a pliable adhesive can be located between the reflective plates 18, 20 and the base plate 22 to reduce vibrations and rattles, but in practice the adhesive may not be required. The clips 70 are then fit around the end surface of the base plate 22 by spreading the legs 74, 76 apart to receive the base plate 22 and reflective plates 18, 20 therebetween.

Once clipped over the end surfaces of the base plate 22, the clips 70 then generally return to their undeformed shape (although the legs 74, 76 may still be slightly spread apart), as the nubs 78 engage the peripheral surfaces of the reflective plates 18, 20. The clips 70 thus engage the outer peripheral surface of the reflective plates 18, 20, and the legs 74, 76 of the clips 70 are pulled into a state of tension to maintain the assembly in place.

Figure 9:
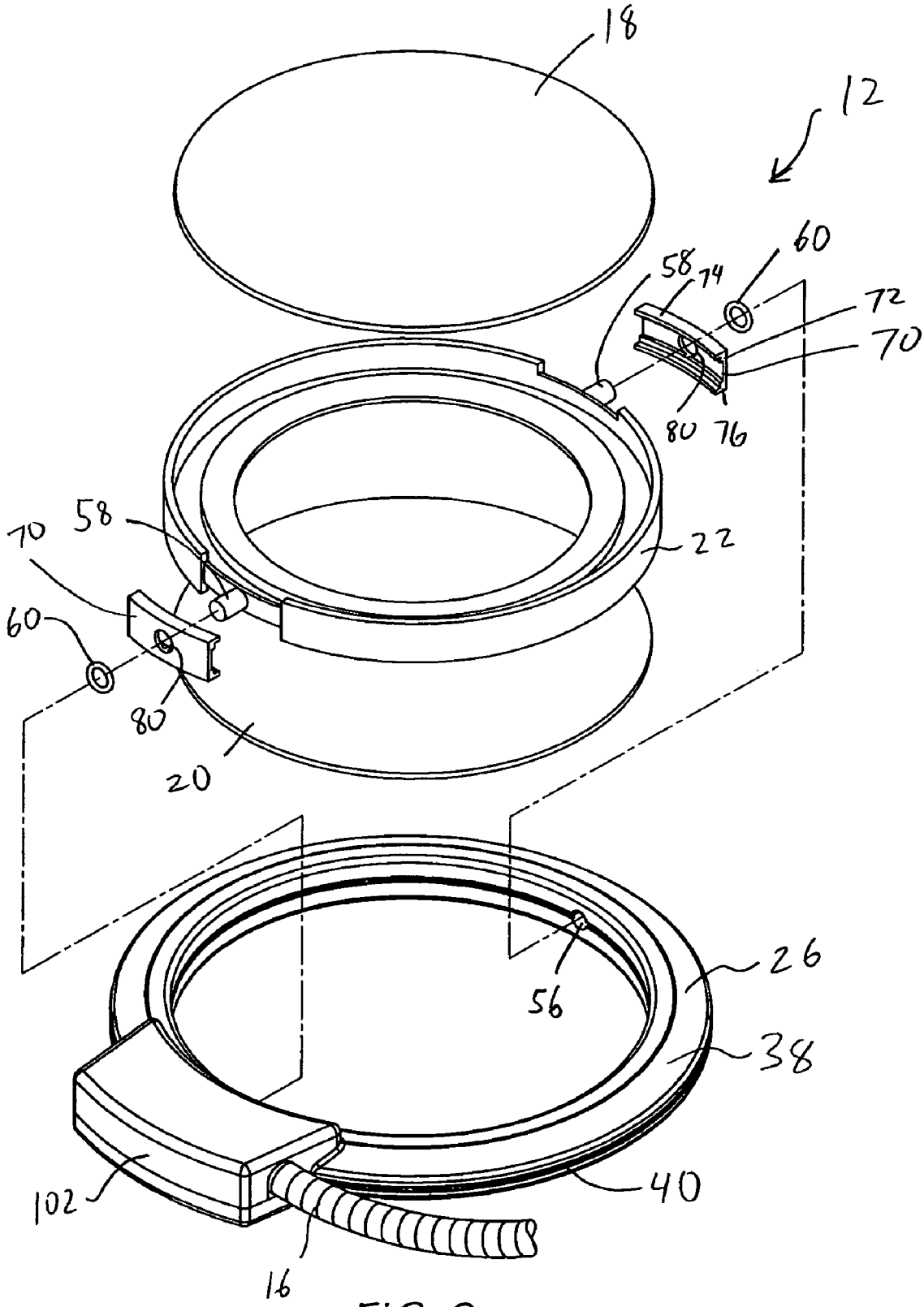
FIG. 9 is an upper perspective view of the mirror assembly of FIG. 8, with the reflective plate assembly further exploded.

The mounting clips 70 and nubs 78 should be sized to provide sufficient clamping force, but the clamping force should not be so strong as to distort the reflective plates 18, 20. The clips should be configured to generally maintain the natural distance d (FIG. 6A) between the outer edges of the reflective plates 18, 20. The size, shape and number of nubs 78 can be varied as desired to accommodate different-shaped reflective plates 18, 20. However, in the illustrated embodiment, each leg 74, 76 includes two nubs 78 located thereon, for a total of four nubs 78 per clip 70. As shown in FIG. 9, each clip 70 may include a generally circular opening 80 to receive a protrusion 58 of the base plate 22 therethrough. The holes 80 and protrusions 78 serve to register and locate the mounting clips 70 in the desired position.

Each coupling clip 70 may extend for a relatively small distance in the radial direction. In particular, each coupling clip 70 may extend no more than about 1/10 (i.e., about 36°) of the outer perimeter of each reflective plate 18, 20. In addition, each reflective plate 18, 20 may have an outer perimeter, and at least about 80%, or at least about 90% of the outer perimeter of each reflective plate 18, 20 may be visible and not covered by the coupling clips 70 or any component of the mirror assembly 10.

In this manner, the coupling clips 70 cover only a small portion of the outer perimeter of the reflective plates 18, 20. This allows the great majority of the surface area and perimeter of the reflective plates 18, 20 to remain uncovered and be used and viewed by a user. Thus, the coupling/attachment method and structure of the present invention allows for significantly increased efficiency of use of the reflective plates 18, 20. The coupling clips 70 also provide for simple, easy, predictable and fast assembly. This manner of assembling the mirror 12 can also eliminate the use of any glue, spacers, self-adhesive materials, sponge materials, and the like.

Each coupling clip 70 may, if desired, be removably coupled to the base plate 22 and the reflective plates 18, 20 to allow the coupling clips 70 to be easily removed or replaced as desired. The mounting clips 70 can also be used when only a single reflective plate 18, 20 is mounted to the base plate 22, in which case the shape of the clip 70 and/or protrusions 78 may need to be adjusted accordingly.

Figure 10:
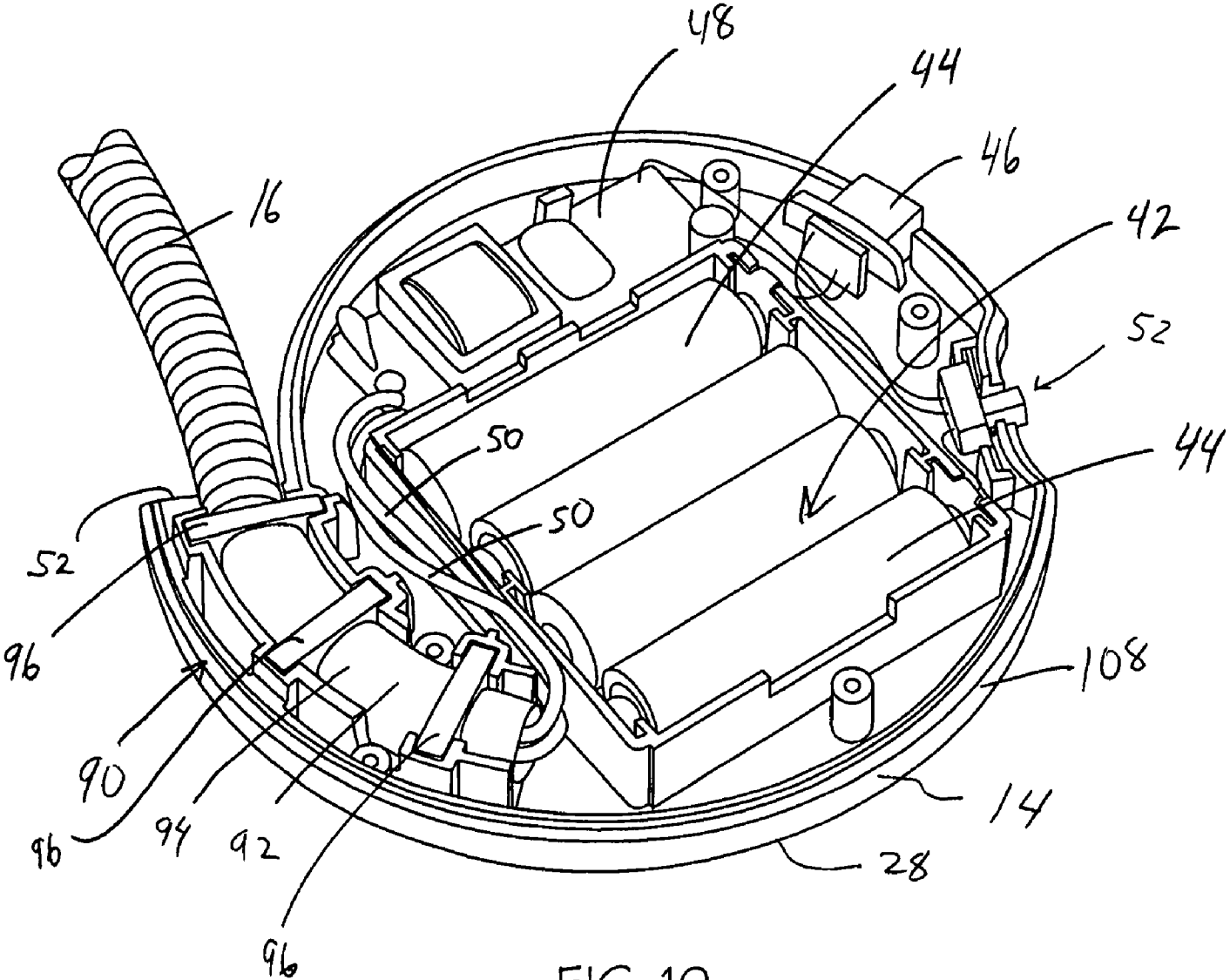
FIG. 10 is a top perspective view of the base of the mirror assembly of FIG. 1, with the covering plate removed.
Figure 11:
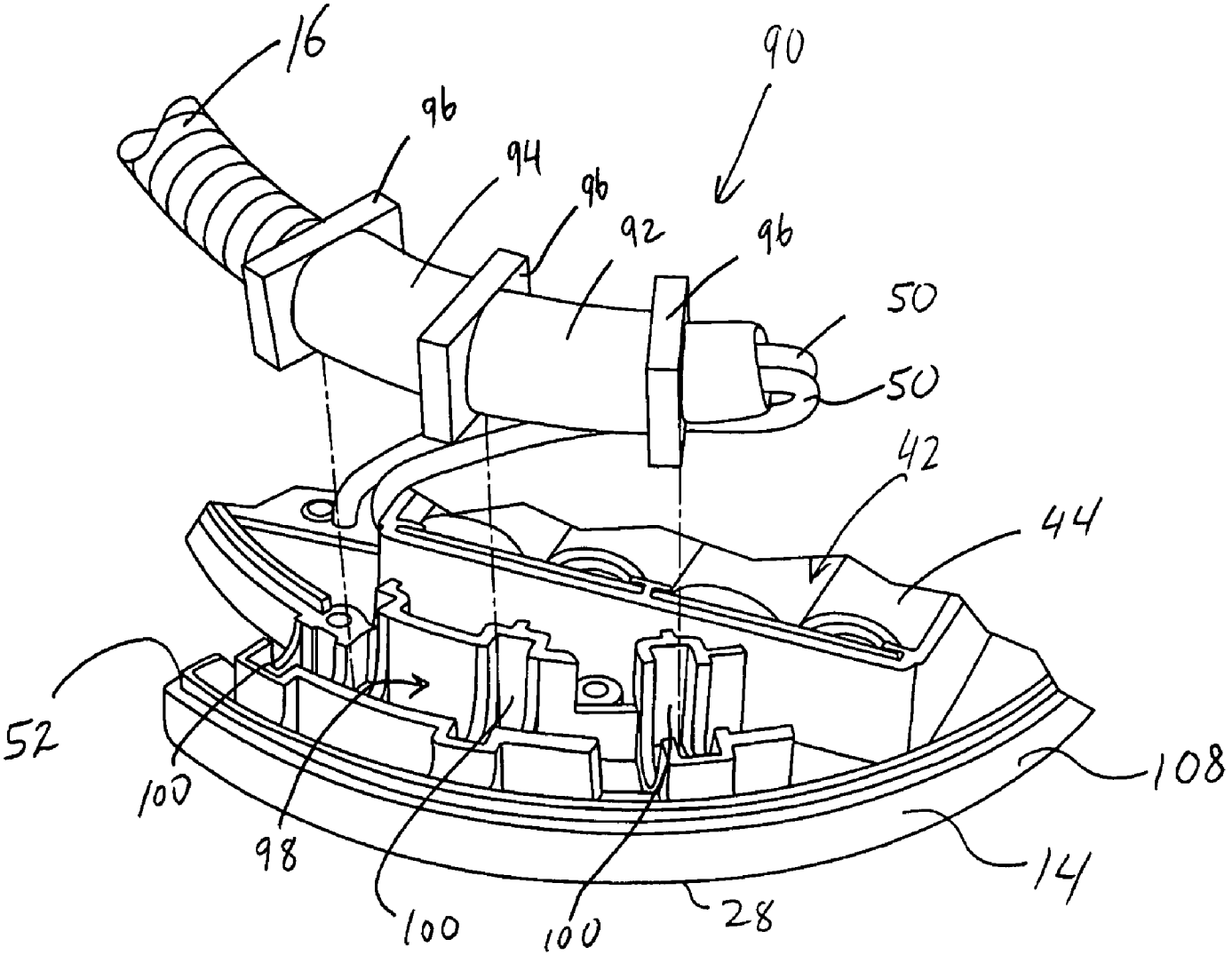
FIG. 11 is a top detail perspective view of the base of FIG. 10, with the plug exploded from the associated receptacle.

The mirror assembly 10 may include an attachment assembly 90 for coupling the neck 16 to the base 14 and/or to the mirror 12. For example, as shown in FIGS. 10 and 11, the attachment assembly 90 may include a plug or coupling portion 92 located on an end of the neck 16. The coupling portion 92 may be a piece of plastic or polymer that is injection molded to the neck 16. Because the neck 16 may include a plurality of spiral grooves located thereon, during the molding process the liquid polymer that forms the coupling portion 92 may seep into the grooves such that, when the polymer hardens, the coupling portion 92 is securely coupled to the neck 16.

In addition, if desired, the neck 16 may include openings or holes (not shown) formed therein that communicate with the central cavity of the neck. In this case during the molding process, part of the polymer forming the coupling portion 92 flows through the openings or holes and into the central cavity of the neck 16. In this case, when hardened, the coupling portion 92 is further secured to the neck 16 and the portions of material located in the neck 16 provide a torque-resisting feature.

The coupling portion 92 may include a generally cylindrical body 94 which may closely conform to the neck 16. If desired, the cylindrical body 94 of the coupling portion 92 may not be entirely continuous and there may be, for example, one or more longitudinally extending gaps formed along the body 94 which expose the neck 16 underneath. The body 92 may include a set of protrusions 96 extending radially outwardly therefrom. In the illustrated embodiment, each of the protrusions 96 is generally square or rectangular, and the body 92 includes three axially aligned protrusions 96.

As shown in FIG. 11, the base 14 may include a receptacle or recess 98 having a shape and curvature which substantially corresponds to the coupling portion 92. In particular, the receptacle 98 may be generally semi-cylindrical in shape with three protrusion-receiving portions 100 located and configured to receive the protrusions 96 therein. In order to couple the neck 16/coupling portion 92 to the base 14, the coupling portion 92 is pressed into the receptacle 98. The coupling portion 92/receptacle 98 may be shaped and sized to form an interference fit therebetween. The coupling portion 92 may have a curvature generally corresponding to that of the outer edge of the base 14, with the receptacle 98 having a corresponding curvature. The natural curvature of the coupling portion 92 also reduces slippage between the coupling portion 92 and neck 16.

The opposite end of the neck 16 from that shown in FIGS. 10 and 11 (i.e., the upper end of the neck 16) may also include a coupling portion (not shown) to be received in a recess (not shown) located in a flange portion 102 of the mirror housing 26. The curvature of the coupling portion shaped to be received in the mirror housing 26 may differ from the curvature of the coupling portion 92 received in the base 14. In particular, the curvature of the receptacle and coupling portion in the mirror housing 26 may have a larger radius of curvature than that of the coupling portion 92/receptacle 98 in the base 14. In this manner, it can be ensured that, during assembly, each end of the neck 16 is inserted in the desired component. Of course, the coupling portions 92, protrusions 96 and receptacles 98 can take any of a wide variety of shapes and sizes beyond those specifically shown herein.

To complete the assembly of the structure of FIG. 10, the upper portion 106 of the base (see FIG. 1) is fit onto or over the lower portion 108 in a "clamshell" fashion. The upper 106 and lower 108 portions are then attached together, such as by screws or other fasteners. If desired, the upper portion 106 of the base 12 may include a receptacle shaped in a manner similar to the receptacle 98 of the lower portion 108 to receive the coupling portion 92 therein.

Once assembled, the attachment assembly 90 securely couples the neck 16 to the base 14. In particular, the protrusions 96 provide a strong resistance to axial forces applied to the neck 16 (i.e., resists attempts to pull the neck 16 out of the base 14). This ensures that the neck 16 is strongly attached to the base so that the connection will not break during unfolding or positioning of the mirror 12 by the user, and assures that the base 14 will not slip or otherwise lose adjustment after positioning by the user. This method of attaching the neck 16 to the base 14 and mirror 12 allows quick and easy attachment without requiring screws, fasteners or adhesives, thereby ensuring easy assembly with confidence and repetitiveness. This method of assembly also reduces operator error and does not require special training or skill.

Having described the invention in detail and by reference to the preferred embodiments, it will be apparent that modifications and variations thereof are possible without departing from the scope of the invention.

What is claimed is:

1. A mirror assembly comprising:

a mirror;

a rigid and generally planar base having a peripheral edge defining an outer perimeter of the base, the base including a radially extending connecting area, the connecting area located at the peripheral edge and being in a spiral shape with respect to a center of the base;

a flexible neck connecting said mirror and said base such that said neck can be manually manipulated to adjust the position of said base and said mirror relative to each other, the neck connecting to the radially extending connecting area of the base;

a light source located on or adjacent to said mirror; and a power-source receiving receptacle located in said base, wherein said power-source receptacle cavity is electrically coupled to said light source;

wherein the base is configured to entirely support the weight of the mirror and the neck when placed on a generally flat surface.

2. The assembly of claim 1 wherein said neck is sufficiently flexible to be manually bent into various shapes but sufficiently rigid to generally retain its position when manually released.

3. The assembly of claim 1 wherein said base has a generally flat support surface configured to lie flat on said generally flat face.

4. The assembly of claim 1 wherein said neck is configurable to extend generally vertically away from said base to position said mirror above said base.

5. The assembly of claim 1 wherein said power-source receiving receptacle is configured to receive power from a power source which provides electrical power to said light source.

6. The assembly of claim 1 wherein said power-source receiving receptacle is a battery compartment.

7. The assembly of claim 1 wherein said power-source receiving receptacle is a port for receiving a power cord that can plug into an A/C outlet.

8. The assembly of claim 1 further comprising wiring located in said neck, wherein said wiring electrically couples said power-source receiving receptacle and said light source.

9. The assembly of claim 1 wherein said light source extends generally around the perimeter of said mirror.

10. The assembly of claim 1 wherein said mirror includes a mirror housing receiving a reflective plate assembly therein.

11. The assembly of claim 10 wherein said light source is located in said mirror housing.

12. The assembly of claim 11 wherein said mirror housing is at least partially translucent.

13. The assembly of claim 10 wherein said reflective plate assembly is generally flat and includes a reflective plate on opposite sides thereof.

14. The assembly of claim 13 wherein said reflective plates each have different magnifications.

15. The assembly of claim 13 wherein said reflective plate assembly is generally mounted within and rotationally coupled to said mirror housing such that said reflective plate assembly is rotatable relative to said mirror housing between a first position wherein one of said reflective plates faces a first direction and a second position wherein the other one of said reflective plates faces said first direction.

16. The assembly of claim 10 wherein said mirror housing and said reflective plate assembly are both generally circular in front view.

17. The assembly of claim 1 wherein said base and said mirror are both generally circular in front view.

18. The assembly of claim 1 wherein said assembly is movable to a compact position wherein said base and said mirror are located immediately adjacent to each other and are generally co-planar, and wherein said neck is generally wrapped around one of said base or said mirror.

19. The assembly of claim 1 wherein said base and said mirror each define a footprint in front view, wherein said footprint of one of said mirror or said base is smaller than the footprint of the other one of said mirror or said base.

20. The assembly of claim 1, wherein the neck is connected to the base at a central portion of a generally planar face of the generally radially extending connecting area such that a central axis of the neck is between two generally planar surfaces of the base and is generally parallel and co-planar with the base at the connecting area, and the generally planar face of the generally radially extending connecting area extends perpendicularly between the two generally planar surfaces.

21. A mirror assembly comprising:

a mirror;

a generally planar and rigid base, the base having two generally planar surfaces and a generally spiral shaped outer perimeter defining an outer perimeter of the base, the generally spiral shaped outer perimeter forming a generally radially extending connecting area;

a flexible neck connecting said mirror and said base such that said neck can be manually manipulated to adjust the position of said base and said mirror relative to each other, the neck connecting to the radially extending connecting area of the base;

a light source located on or adjacent to said mirror; and a power-source receiving receptacle located in said base, wherein said power-source receptacle is electrically coupled to said light source;

wherein the base is configured to entirely support the weight of the mirror and the neck when placed on a generally flat surface, and wherein the neck is connected to the base at a central portion of a generally planar face of the generally radially extending connecting area such that a central axis of the neck is between the two generally planar surfaces and generally parallel and co-planar with the base at the connection area, and the generally planar face of the generally radially extending connecting area extends perpendicularly between the two generally planar surfaces.

* * * * *